US010472195B2

(12) United States Patent
Tsujita

(10) Patent No.: US 10,472,195 B2
(45) Date of Patent: Nov. 12, 2019

(54) IMAGE FORMING SYSTEM, IMAGE FORMING APPARATUS AND METHOD OF CONTROLLING THE SAME

(71) Applicant: CANON KABUSHIKI KAISHA, Tokyo (JP)

(72) Inventor: Kosuke Tsujita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/906,311

(22) Filed: Feb. 27, 2018

(65) Prior Publication Data

US 2018/0257886 A1 Sep. 13, 2018

(30) Foreign Application Priority Data

Mar. 9, 2017 (JP) ..... 2017-045254

(51) Int. Cl.

| | |
|---|---|
| ***B65H 7/20*** | (2006.01) |
| ***B65H 1/04*** | (2006.01) |
| ***B65H 3/14*** | (2006.01) |
| ***B65H 3/04*** | (2006.01) |
| ***B65H 3/48*** | (2006.01) |
| ***G03G 15/00*** | (2006.01) |

(52) U.S. Cl.

CPC ..... *B65H 7/20* (2013.01); *B65H 1/04* (2013.01); *B65H 3/047* (2013.01); *B65H 3/14* (2013.01); *B65H 3/48* (2013.01); *G03G 15/502* (2013.01); *G03G 15/6508* (2013.01); *B65H 2405/15* (2013.01); *B65H 2511/415* (2013.01); *B65H 2511/416* (2013.01); *B65H 2511/528* (2013.01); *B65H 2515/112* (2013.01); *B65H 2515/212* (2013.01); *B65H 2601/11* (2013.01); *B65H 2601/255* (2013.01); *G03G 15/50* (2013.01)

(58) Field of Classification Search

CPC ... B65H 1/28; B65H 3/08; B65H 3/14; B65H 3/44; B65H 5/26; B65H 7/00; B65H 7/02; B65H 7/06; B65H 7/16; B65H 7/18; B65H 7/20; B65H 2405/33; B65H 2405/331; B65H 2405/332; B65H 2511/528; B65H 2515/112; B65H 2601/11; B65H 2601/255

See application file for complete search history.

(56) References Cited

U.S. PATENT DOCUMENTS

| | | | | |
|---|---|---|---|---|
| 9,575,451 | B2 | 2/2017 | Tsujita | |
| 2009/0057986 | A1* | 3/2009 | Yaginuma | B65H 1/14 271/11 |
| 2009/0146363 | A1* | 6/2009 | Hosoi | B65H 3/12 271/9.01 |
| 2011/0221119 | A1* | 9/2011 | Fuda | B65H 3/128 271/11 |
| 2013/0321863 | A1* | 12/2013 | Fukuda | B65H 3/44 358/1.15 |
| 2016/0107854 | A1* | 4/2016 | Hashimoto | B65H 7/02 271/11 |

FOREIGN PATENT DOCUMENTS

| | | |
|---|---|---|
| JP | 2000-094823 A | 4/2000 |

* cited by examiner

*Primary Examiner* — Prasad V Gokhale
(74) *Attorney, Agent, or Firm* — Venable LLP

(57) ABSTRACT

An image forming apparatus having a printer for printing an image on a sheet fed from an external sheet feeding apparatus sets the sheet feeding apparatus as a sheet feed source of the sheet to be used by the printer for printing and in accordance with the setting, makes a notification so as to notify a user to set a feeding parameter in the sheet feeding apparatus.

10 Claims, 13 Drawing Sheets

FIG. 8A

PLEASE MAKE SHEET SETTING IN SHEET FEEDING APPARATUS

PLEASE MAKE SHEET SETTING ON OPERATION UNIT OF SHEET FEEDING APPARATUS
FOLLOWING ARE RECOMMENDED VALUES OF AIR-VOLUME PARAMETERS

SHEET SET IN IMAGE FORMING APPARATUS IS "FOR COMPANY A_THICK PAPER 2" 801

AIR VOLUME OF SHEET ABSORPTIVE FAN 86–90 802

AIR VOLUME OF SHEET SEPARATION FAN 81–90

OK 803

FIG. 8B

| GRAMMAGE (gsm) | AIR VOLUME OF SHEET ABSORPTIVE FAN (%) |
|---|---|
| ~ 59 | 64 |
| 60 ~ 90 | 65 ~ 80 |
| 91 ~ 115 | 81 ~ 85 |
| 116 ~ 135 | 86 ~ 90 |
| 136 ~ 199 | 91 ~ 99 |
| 200 ~ | 100 |

FIG. 8C

| GRAMMAGE (gsm) | AIR VOLUME OF SHEET SEPARATION FAN (%) |
|---|---|
| ~ 59 | 64 |
| 60 ~ 90 | 65 ~ 79 |
| 91 ~ 115 | 80 |
| 116 ~ 135 | 81 ~ 90 |
| 136 ~ 200 | 91 ~ 95 |
| 201 ~ 249 | 96 ~ 99 |
| 250 ~ | 100 |

FIG. 9A

901

| SHEET NAME | SHEET NAME IN SHEET FEEDING APPARATUS |
|---|---|
| FOR COMPANY A_THICK PAPER 2 | a_company_heavy2 |
| none | none |
| none | none |

FIG. 9B

902

PLEASE MAKE SHEET SETTING IN SHEET FEEDING APPARATUS

NEW SHEET IS SET IN IMAGE FORMING APPARATUS

PLEASE MAKE SHEET SETTING IN ACCORDANCE WITH FOLLOWING RECOMMENDED VALUES ON OPERATION UNIT OF SHEET FEEDING APPARATUS

AIR VOLUME OF SHEET ABSORPTIVE FAN 86~90 903

AIR VOLUME OF SHEET SEPARATION FAN 81~90

OK 904

FIG. 9C

905

SHEET NAME REGISTRATION IN SHEET FEEDING APPARATUS

PLEASE INPUT SHEET NAME MANAGED BY SHEET FEEDING APPARATUS

SHEET NAME MANAGED BY IMAGE FORMING APPARATUS FOR COMPANY A_THICK PAPER 2 906

SHEET NAME MANAGED BY SHEET FEEDING APPARATUS a_company_heavy2 907

OK 908

IMAGE FORMING SYSTEM, IMAGE FORMING APPARATUS AND METHOD OF CONTROLLING THE SAME

BACKGROUND OF THE INVENTION

Field of the Invention

Embodiments described herein generally relate to an image forming system, an image forming apparatus, and a method of controlling the same.

Description of the Related Art

In recent years, along with improvement of the performance of an image forming apparatus, sheet types to be handled by the image forming apparatus have increased. A sheet used for printing is defined by attributes indicating features of the sheet such as a size, grammage, a surface property, and the like. So far, the image forming apparatus has widened the range of printable sheet types by handling sheets of more attributes and coped with a variety of user requests. The image forming apparatus stores a sheet type used for printing in advance, and a user sets a sheet type set for each sheet feed tray. The image forming apparatus sets the conveyance speed of a sheet, the temperature of a fixing unit, density adjustment, and the like at the time of printing based on the type of sheet used for printing and prints an image on the sheet in the setting.

Conventionally, a maker that manufactures an image forming apparatus registers sheet types to the image forming apparatus upon shipping as specifications in consideration of a normal operation range of the apparatus. It is also possible that the user newly sets sheet characteristic information and registers it as a new sheet type. The user who has set a sheet to the sheet feed tray registers the sheet types to the sheet feed trays from a UI screen displayed on a display connected to the image forming apparatus. It is possible to register the sheet types to the sheet feed trays by, for example, displaying a list of the sheet types registered in the image forming apparatus on the UI screen, and making the user select a sheet type set to the sheet feed tray from the list.

In POD (Print On Demand), when many sheets are used in one print job, when a sheet needed by each user is used in an office environment having an indefinite number of users, or the like, sheet changeover work occurs in various application purposes and scenarios. In this case, the users need to operate the UI screen and set a sheet type each time. If such a sheet changeover occurs frequently, not only a load on each user may increase, but also human error such as forgetting to set the sheet type may occur.

Japanese Patent Laid-Open No. 2000-94823 proposes a method of detecting that a user opens a sheet feed tray, reducing a labor of the user to display a registration screen for a sheet type in the detected sheet feed tray on a UI screen by outputting the registration screen to the UI screen, and preventing forgetting to set the sheet type.

As a printing application diversifies, print accessories that satisfy user requests are developed. For example, a sheet feeding apparatus that implements large-volume and high-speed feeding is one of these accessories. It becomes possible to perform a lot of printing in one sheet feeding operation or perform a lot of printing at a high speed by attaching the sheet feeding apparatus to the image forming apparatus. The above-described sheet feeding apparatus includes setting items unique to the sheet feeding apparatus, and feeding from the sheet feeding apparatus to the image forming apparatus becomes possible by causing the user to set those setting items. In order to feed a sheet set in the sheet feeding apparatus correctly, however, a sheet setting on a UI set in each of the image forming apparatus and the sheet feeding apparatus is needed. Therefore, if even one of the sheet registration/setting works on the UIs is ignored, a state in which different sheets are set in the image forming apparatus and the sheet feeding apparatus may occur, resulting in causing an image failure or a feed jam.

SUMMARY OF THE INVENTION

An aspect of the present invention is to eliminate the above-mentioned problem with conventional technology.

According to a first aspect of the present invention, there is provided an image forming apparatus having a printer for printing an image on a sheet fed from a sheet feeding apparatus, the image forming apparatus comprising: a memory device that stores a set of instructions; and at least one processor that executes the instructions to function as: a setting unit that sets the sheet feeding apparatus as a sheet feed source of the sheet to be used by the printer for printing; and a notification unit that notifies a user to set a feeding parameter of the sheet feeding apparatus in accordance with a setting by the setting unit.

According to a second aspect of the present invention, there is provided an image forming system that includes an image forming apparatus, and an external sheet feeding apparatus that is connected to the image forming apparatus and feeds a sheet to the image forming apparatus, the image forming apparatus comprising: a first memory device that stores a set of instructions; and at least one first processor that executes the instructions to function as: a first setting unit that sets the sheet feeding apparatus as a sheet feed source of the sheet to be used by the image forming apparatus for printing; and a first notification unit that, in accordance with a setting by the first setting unit, makes a notification that notifies a user to set a feeding parameter in the sheet feeding apparatus, the sheet feeding apparatus comprising: a second memory device that stores a set of instructions; and at least one second processor that executes the instructions to function as: a second setting unit that sets a feeding parameter of the sheet fed from the sheet feeding apparatus to the image forming apparatus.

According to a third aspect of the present invention, there is provided a method of controlling an image forming apparatus capable of printing an image on a sheet fed from an external sheet feeding apparatus, the method comprising: setting the sheet feeding apparatus as a sheet feed source of the sheet to be used for printing an image; and prompting a user to set a feeding parameter in the sheet feeding apparatus set as the sheet feed source of the sheet in the setting.

Further features of the present invention will become apparent from the following description of exemplary embodiments (with reference to the attached drawings).

BRIEF DESCRIPTION OF THE DRAWINGS

FIG. 8A depicts a view showing an example of a screen for prompting a sheet setting in the sheet feeding apparatus displayed on the UI panel of the image forming apparatus according to the first embodiment;

FIGS. 8B and 8C depict views each for explaining a table that stores parameters according to sheet grammage of a sheet absorptive fan and a sheet separation fan;

FIG. 9A depicts a view showing an example of a table by which the image forming apparatus manages a sheet name set in the sheet feeding apparatus;

FIG. 9B depicts a view showing an example of a screen for prompting a sheet setting in the sheet feeding apparatus displayed on the UI panel of the image forming apparatus;

FIG. 9C depicts a view showing an example of a screen for accepting the sheet name input by a user on the UI panel of sheet feeding apparatus displayed on the UI panel of the image forming apparatus;

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

[First Embodiment]

Figure 1A:
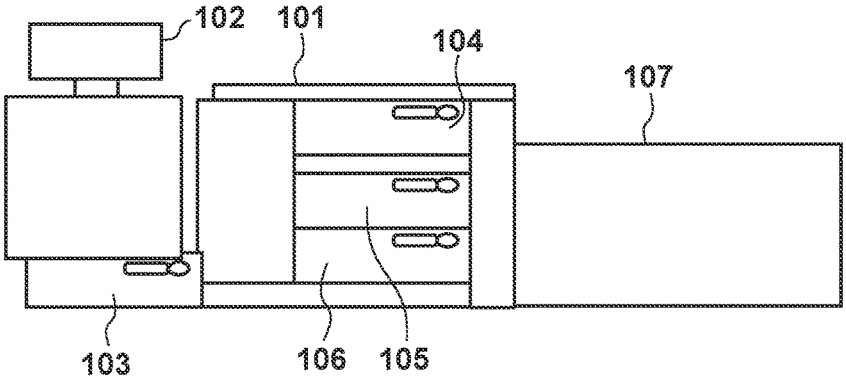
FIGS. 1A to 1C depict schematic views each showing an example of a printing system according to the first embodiment.
Figure 1B:
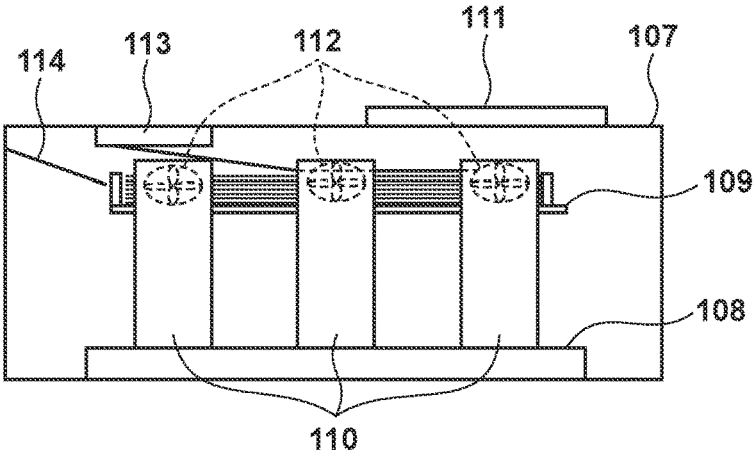
Figure 1C:
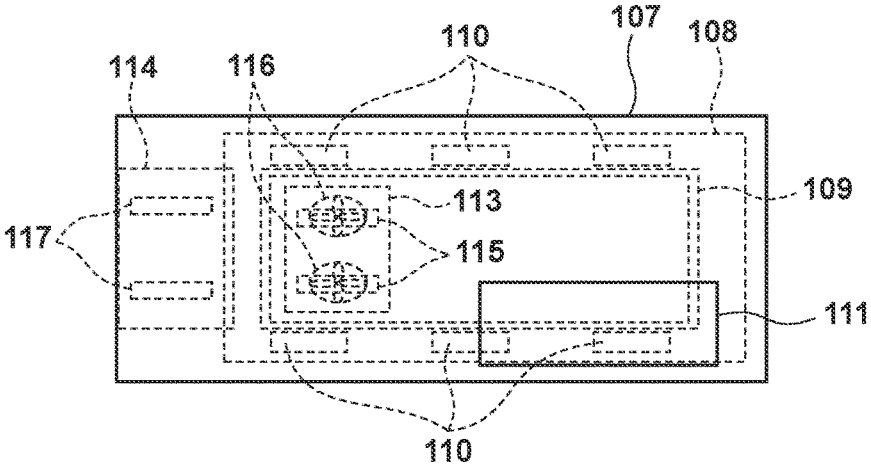

FIGS. 1A to 1C depict schematic views each showing an example of a printing system according to the first embodiment. This printing system includes an image forming apparatus 101 and a sheet feeding apparatus 107. The sheet feeding apparatus 107 is a large-volume sheet feeding apparatus and can feed sheets set in the sheet feeding apparatus 107 to the image forming apparatus 101 at a high speed.

FIG. 1A depicts a front view of the image forming apparatus 101 connected to the sheet feeding apparatus 107. The image forming apparatus 101 is, for example, an image forming apparatus of an electrophotographic type. A UI panel (operation panel) 102 is, for example, a user interface that includes a touch panel of a capacitance type. Moreover, the image forming apparatus 101 can print images on sheets fed from sheet feed trays 103 to 106 and the sheet feeding apparatus 107.

FIG. 1B depicts the schematic view showing a section when the sheet feeding apparatus 107 is viewed from the front. FIG. 1C depicts the schematic view when the sheet feeding apparatus 107 is viewed from the top.

A dolly 108 is in contact with sheet lifters 110 that include sheet separation fans 112 and a sheet base 109, and can be drawn out of the sheet feeding apparatus 107 to the near (front In FIG. 1B) side. A user sets sheets on the sheet base 109 of the drawn dolly 108 and supplies sheets by returning the dolly 108 to the sheet feeding apparatus 107. A UI panel (operation panel) 111 is an interface that inputs feeding parameters of the sheets set on the sheet base 109. A sheet conveyer 113 includes sheet conveyance belts 115 and sheet absorptive fans 116. A sheet conveyance path 114 includes sheet conveyance belts 117.

A mechanism in which this sheet feeding apparatus 107 feeds one sheet to the image forming apparatus 101 will be described next. First, the sheet separation fans 112 blow a sheet bundle loaded on the sheet base 109 to separate the sheet bundle. Consequently, one sheet floats from the sheet bundle loaded on the sheet base 109. Such a sheet separation method by blowing is known, and thus a detailed description thereof will be omitted. The sheet absorptive fans 116 absorb the one sheet floating from the sheet bundle by sheet separation to the sheet conveyance belts 115. The sheet conveyance belts 115 move the sheet to the sheet conveyance path 114. Subsequently, the sheet conveyance belts 117 provided in the sheet conveyance path 114 convey and feed the above-described sheet to the image forming apparatus 101.

Figure 2:
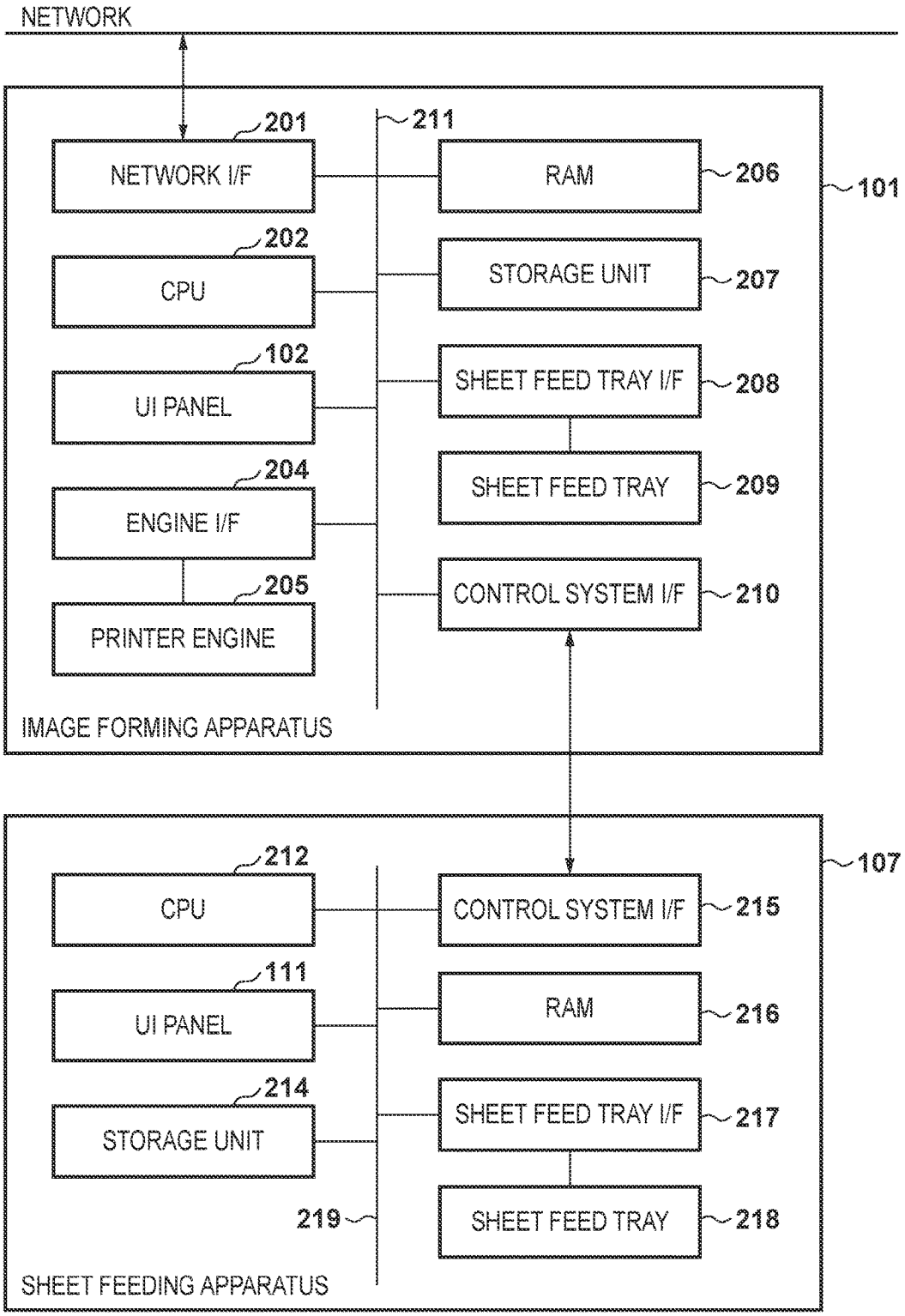
FIG. 2 is a block diagram for explaining the hardware arrangements of an image forming apparatus and a sheet feeding apparatus according to the first embodiment.

FIG. 2 is a block diagram for explaining the hardware arrangements of the image forming apparatus 101 and the sheet feeding apparatus 107 according to the first embodiment.

First, the hardware arrangement of the image forming apparatus 101 will be described. A network I/F 201 communicates with another apparatus such as a host computer via a network. A CPU (Central Processing Unit) 202 performs control and arithmetic operations of respective units of the image forming apparatus 101 via a bus 211. Furthermore, the operation of this apparatus is controlled by deploying programs stored in a storage unit 207 to a RAM (Random Access Memory) 206 and executing them. The RAM 206 is a general volatile memory directly accessible from the CPU 202, and used as a work area of the CPU 202 and another temporary data storage area. The storage unit 207 functions as a temporary storage area and a work memory when the apparatus operates. An engine I/F 204 performs control and communication with a printer engine 205. A sheet feed tray I/F 208 performs control and communication with a sheet feed tray 209. The sheet feed tray 209 is a generic name for the above-described sheet feed trays 103 to 106 as hardware arrangements. The UI panel 102 functions as a user interface of this image forming apparatus 101. In the first embodiment, the UI panel 102 includes a touch panel of a capacitance type. A control system I/F (interface) 210 controls an interface with the sheet feeding apparatus 107 and sends a feed signal to the sheet feeding apparatus 107 or receives, for example, a signal indicating sheet discharge from the sheet feeding apparatus 107.

The hardware arrangement of the sheet feeding apparatus 107 will be described next. A CPU 212 performs control and arithmetic operations of respective units of the sheet feeding apparatus 107 via a bus 219. The CPU 212 controls the sheet feeding apparatus 107 by deploying programs stored in a storage unit 214 to a RAM 216 and executing them. The RAM 216 is a general volatile memory directly accessible from the CPU 212, and used as a work area of the CPU 212 and another temporary data storage area. The storage unit 214 functions as a temporary storage area and a work memory when the apparatus operates. A sheet feed tray I/F 217 performs control and communication with a sheet feed tray 218. The sheet feed tray 218 is a generic name for the sheet base 109, the sheet separation fans 112, the sheet conveyance belts 115, the sheet absorptive fans 116, the sheet conveyance belts 117, and the like shown in FIG. 1 as hardware arrangements. The UI panel 111 is a user interface of the sheet feeding apparatus 107. A control system I/F 215 controls an interface with the image forming apparatus 101 and performs an operation of, for example, receiving a feed signal from the image forming apparatus 101 and transmitting it as a signal indicating sheet discharge. In the first embodiment, the UI panel 111 includes a touch panel of a capacitance type.

Figure 3A:
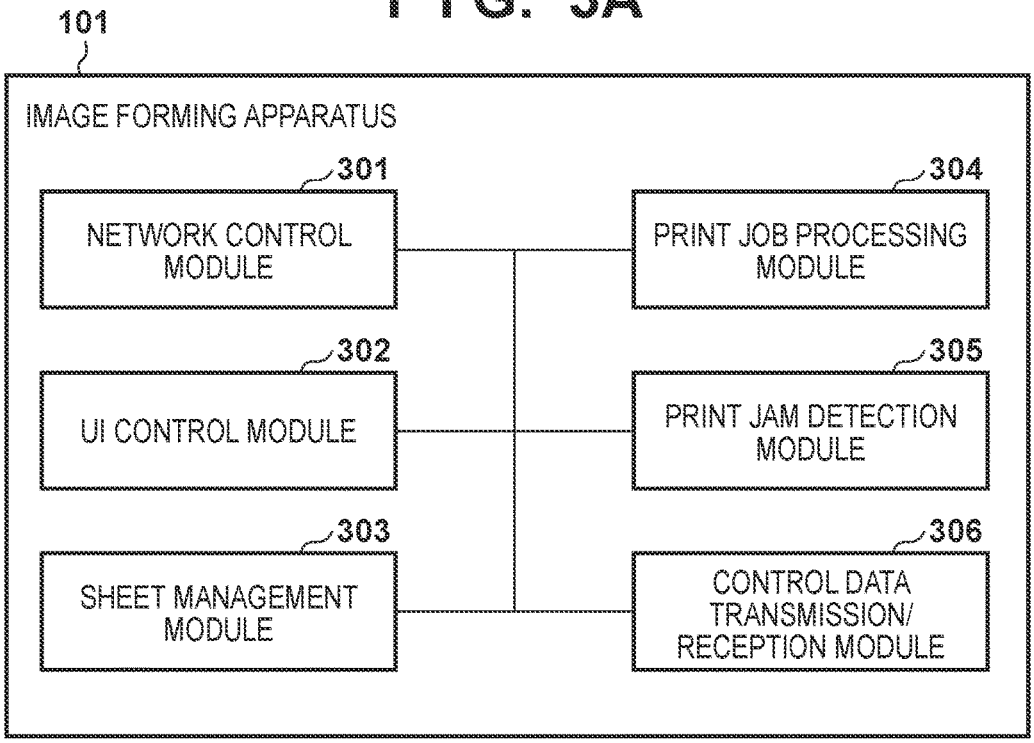
FIGS. 3A and 3B are block diagrams for explaining software modules of the image forming apparatus and the sheet feeding apparatus according to the first embodiment.
Figure 3B:
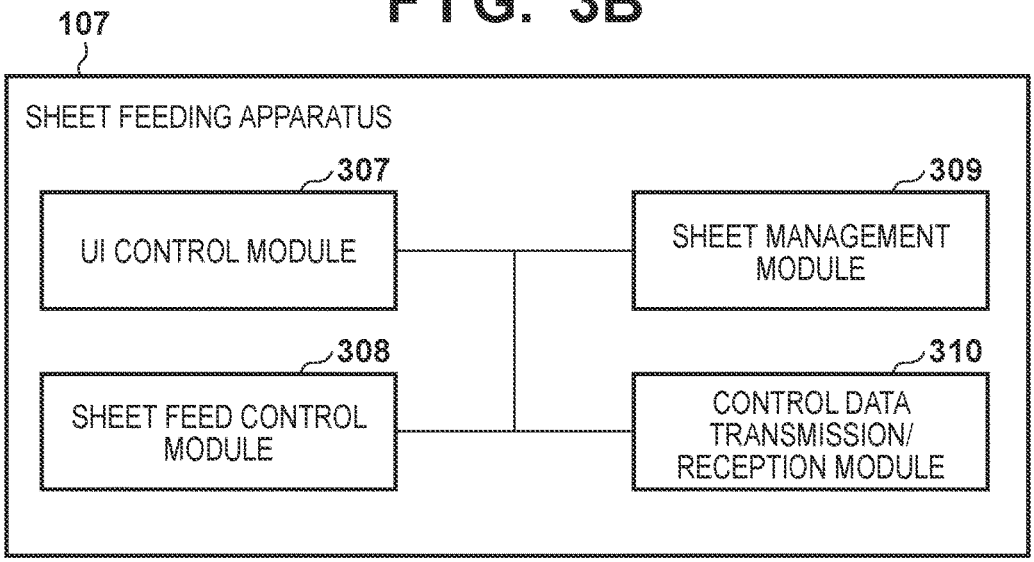

FIGS. 3A and 3B are block diagrams for explaining software modules of the image forming apparatus 101 and the sheet feeding apparatus 107 according to the first embodiment.

FIG. 3A is the block diagram for explaining the software modules of the image forming apparatus 101 according to the first embodiment.

Each software module of the image forming apparatus 101 is stored in the storage unit 207 of the image forming apparatus 101 as a program. Each function is achieved by causing the CPU 202 to deploy a corresponding one of the programs to the RAM 206 and execute it. A network control module 301 communicates with another apparatus such as a host computer via a network. A UI control module 302 displays a screen on the UI panel 102 and accepts an operation from the user via the UI panel 102. A sheet management module 303 manages sheet feed source information accepted from the UI panel 102 and sheet information set in the sheet feed source. The sheet management module 303 further manages a correspondence relationship between sheet names set in the image forming apparatus 101 and the sheet feeding apparatus 107. A print job processing module 304 processes a print job accepted via the UI panel 102 or a print job accepted via the network I/F 201 and controls whether to perform printing. A print jam detection module 305 detects occurrence of a jam based on signals from various sensors (not shown) provided on a sheet conveyance path of the image forming apparatus 101. A control data transmission/reception module 306 exchanges a signal regarding feeding with the sheet feeding apparatus 107 via the control system I/F 210.

FIG. 3B is the block diagram for explaining the software modules of the sheet feeding apparatus 107 according to the first embodiment.

Each software module of the sheet feeding apparatus 107 is stored in the storage unit 214 of the sheet feeding apparatus 107 as a program. Each function is achieved by causing the CPU 212 to deploy a corresponding one of the programs to the RAM 216 and execute it. A UI control module 307 performs display on the UI panel 111 and further accepts an operation from the user via the UI panel 111. A sheet management module 309 manages, for each sheet, a feeding parameter for feeding the sheet accepted via the UI panel 111. Based on the feeding parameters of the sheets stored in the sheet management module 309, a sheet feed control module 308 controls the sheet separation fans 112, the sheet conveyance belts 115, the sheet absorptive fans 116, the sheet conveyance belts 117, and the like of the sheet feeding apparatus 107 to feed the sheets. The sheet feed control module 308 further controls whether to feed the sheets. A control data transmission/reception module 310 exchanges a signal regarding feeding with the image forming apparatus 101 via the control system I/F 215.

Figure 4:
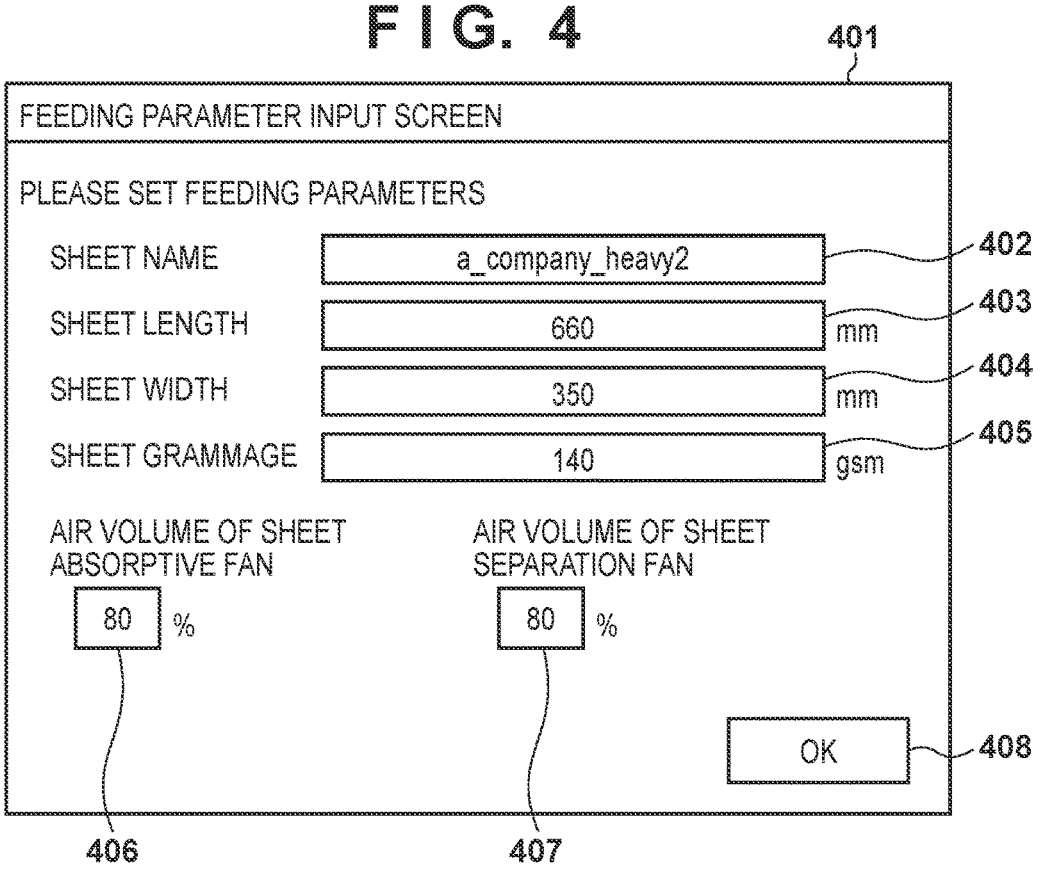
FIG. 4 depicts a view showing an example of a screen for inputting parameters for feeding a sheet displayed on a UI panel of the sheet feeding apparatus according to the first embodiment.

FIG. 4 depicts a view showing an example of a screen 401 for inputting parameters for feeding a sheet displayed on the UI panel 111 of the sheet feeding apparatus 107 according to the first embodiment. This screen 401 is displayed by the UI control module 307 by an instruction of the CPU 212 and displayed on the UI panel 111 of the sheet feeding apparatus 107.

At this time, the user operates the UI panel 111 to display a keyboard (not shown) and operates the keyboard to input each feeding parameter on the screen 401. Each feeding parameter input from the keyboard by the user will be described here.

A sheet name input field 402 is an area for inputting a sheet name, and a general sheet name or a name determined by the user is input. A sheet length input field 403 is an area for inputting a sheet length in a conveyance direction. A sheet width input field 404 is an area for inputting a sheet width. The sheet width is a sheet length in a direction perpendicular to the conveyance direction. A sheet grammage input field 405 is an area for inputting sheet grammage. An area 406 is an area for inputting a volume of air blown by the sheet absorptive fans 116 of the sheet conveyer 113. An area 407 is an area for inputting a volume of air blown by the sheet separation fans 112. When the user inputs these feeding parameters and presses an OK button 408 from the screen 401, the sheet management module 309 stores these input feeding parameters in the storage unit 214.

In order to feed sheets from the sheet feeding apparatus 107, both the UI panel 102 of the image forming apparatus 101 and the UI panel 111 of the sheet feeding apparatus 107 need to make settings regarding the feeding. Based on the type of sheet to be fed, the image forming apparatus 101 controls a sheet conveyance speed, the temperature of a fixing unit, density adjustment, and the like at the time of printing. Therefore, if the type of sheet to be fed actually is different from that of set sheet, a fixing error of an image to the sheet or a feed jam may occur. Moreover, in inputting the parameters for feeding the sheets in the sheet feeding apparatus 107, if the user fails to input the air volumes of the sheet absorptive fans 116 and the air volumes of the sheet separation fans 112, the sheets may not be separated well or fail to be conveyed. Sheet conveyance may also fail if the feeding parameters input in the sheet feeding apparatus 107 and the parameters set in the image forming apparatus 101 are different.

For these reasons, if the user fails the sheet setting or makes an erroneous setting in one of the image forming apparatus 101 and the sheet feeding apparatus 107, a feed failure or a printing error may occur. To cope with this, in this embodiment, such sheet conveyance failures are prevented by a method below.

Figure 5:
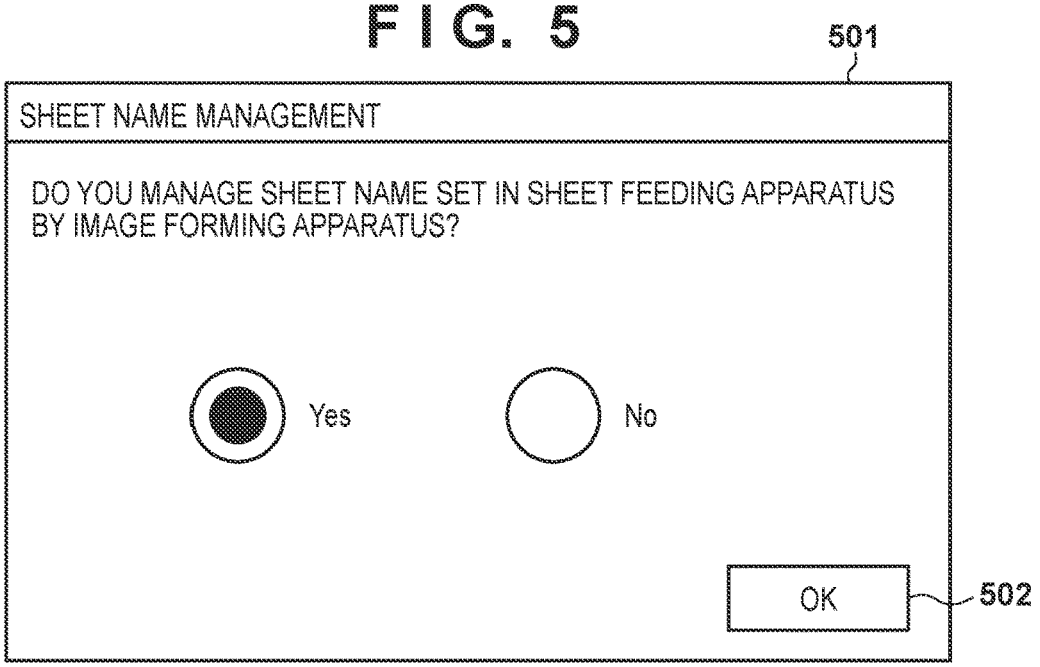
FIG. 5 depicts a view showing an example of a confirmation screen displayed on a UI panel of the image forming apparatus according to the first embodiment.

FIG. 5 depicts a view showing an example of a confirmation screen displayed on the UI panel 102 of the image forming apparatus 101 according to the first embodiment. This confirmation screen 501 shows an example of a screen for setting whether to manage a sheet name set in the sheet feeding apparatus 107 by the image forming apparatus 101.

The screen 501 is displayed on the UI panel 102 by causing the CPU 202 to extract information on the screen from the storage unit 207 and instruct the UI control module 302 to display it. When the user selects "Yes" or "No" and presses an OK button 502 on this screen 501, the CPU 202 stores the information in the storage unit 207. FIG. 5 shows a state in which the user selects "Yes", that is, a state in which the user gives an instruction to manage the sheet name set in the sheet feeding apparatus 107 by the image forming apparatus 101. If the sheet name set in the sheet feeding apparatus 107 is managed by the image forming apparatus 101, the image forming apparatus 101 stores, in the storage unit 207, the sheet name set in the image forming apparatus and the sheet name set in the sheet feeding apparatus 107 in association with each other. The sheet names set in the image forming apparatus 101 and the sheet feeding apparatus 107 may be different from each other. It is possible to specify a sheet corresponding to the sheet set in the image forming apparatus 101 of the sheets set in the sheet feeding apparatus 107 by associating the sheet name set in the image forming apparatus 101 with the sheet name set in the sheet feeding apparatus 107.

Figure 6A:
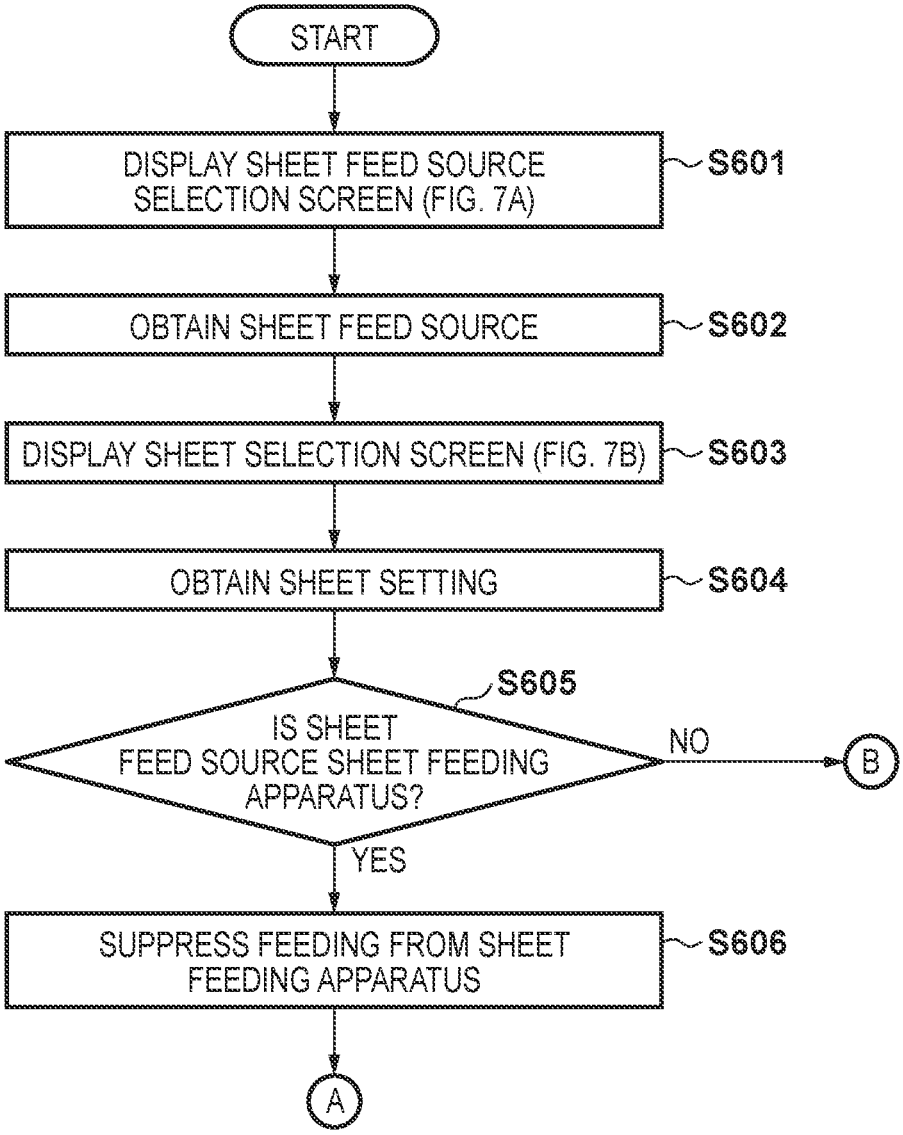
FIGS. 6A and 6B are flowcharts for describing a process by the image forming apparatus according to the first embodiment.
Figure 6B:
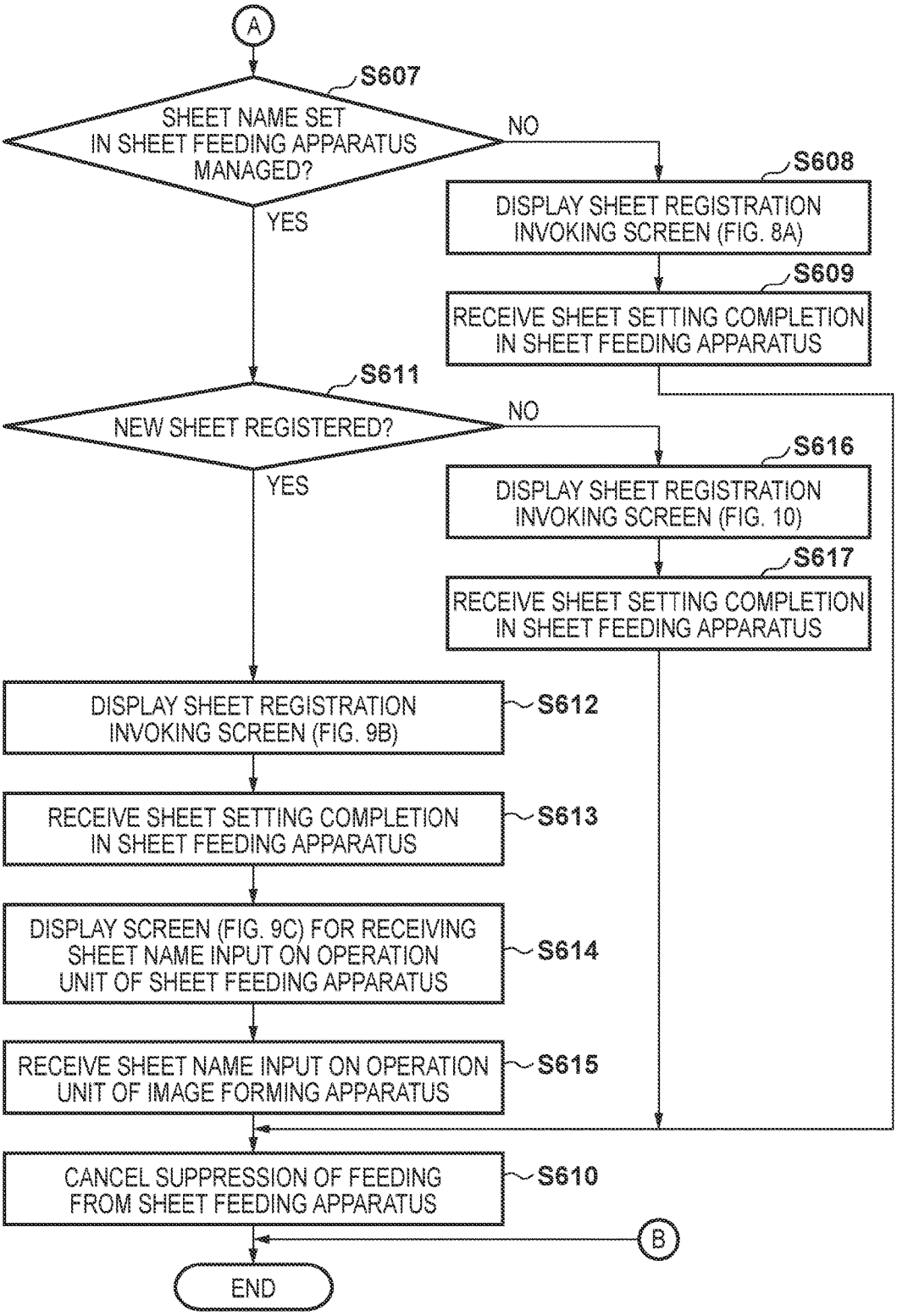

FIGS. 6A and 6B are flowcharts for describing a process by the image forming apparatus 101 according to the first embodiment. The process shown in this flowchart is achieved by causing the CPU 202 to deploy programs stored in the storage unit 207 to the RAM 206 and execute them. This process is started by causing the user to operate the UI panel 102 and give an instruction to select a sheet feed source.

Figure 7A:
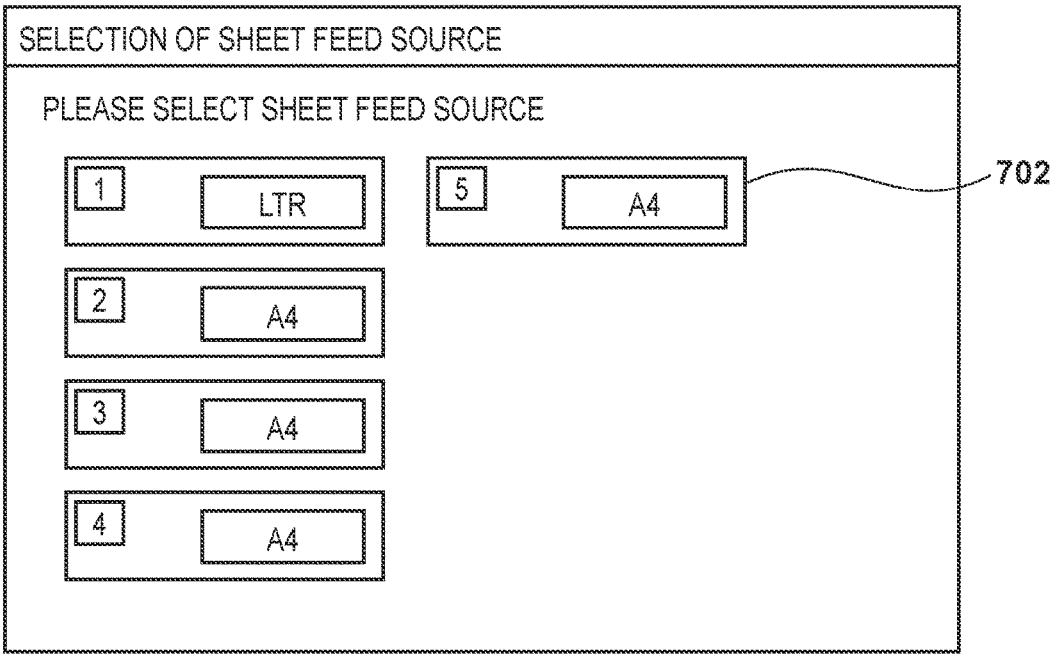
FIG. 7A depicts a view showing an example of a sheet feed source selection screen displayed on the UI panel of the image forming apparatus according to the first embodiment.

FIG. 7A depicts a view showing an example of a sheet feed source selection screen displayed on the UI panel 102 of the image forming apparatus 101.

In FIG. 7A, sheet feed tray numbers "1" to "5" correspond to the sheet feed trays 103 to 106 and the sheet feeding apparatus 107, respectively. That is, a sheet feed tray number "5" 702 corresponds to the sheet feeding apparatus 107.

First, in step S601, the CPU 202 displays the screen shown in FIG. 7A on the UI panel 102. Next, the process advances to step S602 in which the CPU 202 obtains a sheet feed source selected by the user via the screen displayed on the UI panel 102 and stores the selected sheet feed source in the storage unit 207. Next, the process advances to step S603 in which the CPU 202 displays, for example, a sheet selection screen as shown in FIG. 7B on the UI panel 102.

Figure 7B:
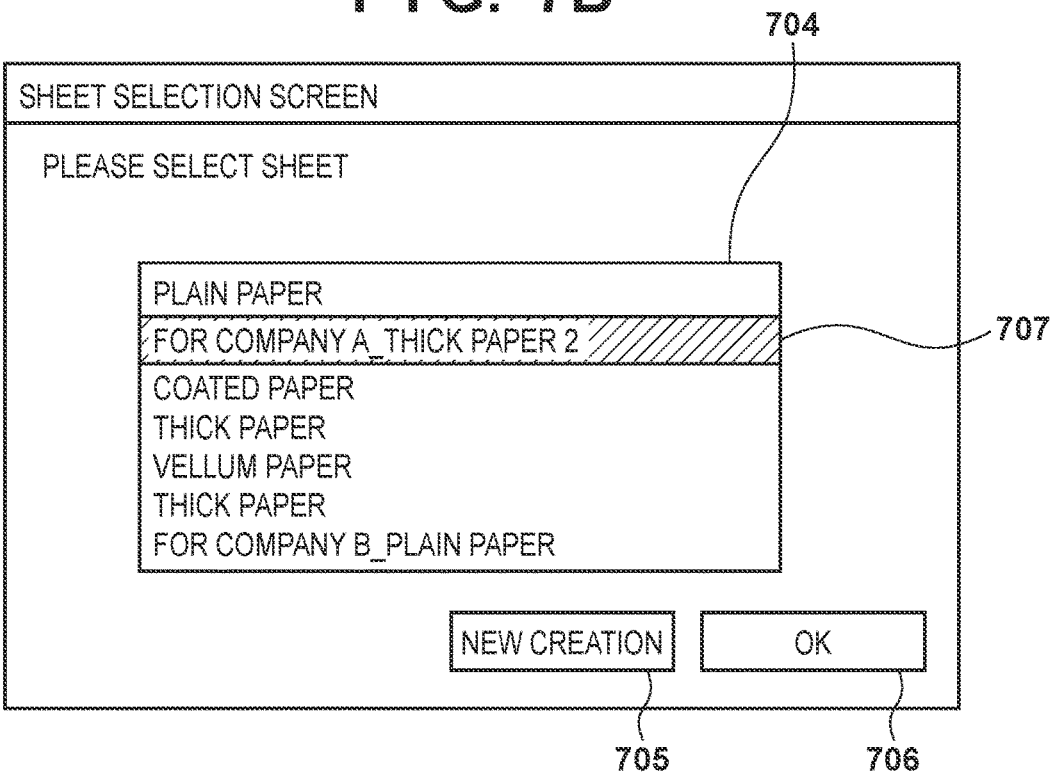
FIG. 7B depicts a view showing an example of a sheet selection screen displayed on the UI panel of the image forming apparatus.

FIG. 7B depicts a view showing an example of the sheet selection screen displayed on the UI panel 102 of the image forming apparatus 101.

The CPU 202 obtains registered sheet names from the storage unit 207 and displays them in a sheet list 704. Note that although not illustrated, each registered sheet has a sheet size and grammage as attributes. Reference numeral 707 displays a sheet name "for company A_thick paper 2" corresponding to "a company heavy2" input in the sheet name input field 402 on a feeding parameter input screen of FIG. 4.

If the user wants to designate a new sheet name, he/she presses a "new creation" button 705. Consequently, the CPU 202 obtains information on a sheet name creation screen (not shown) from the storage unit 207 and displays it on the UI panel 102. Then, the user can create and register the new sheet name via the screen displayed on the UI panel 102. The sheet name thus created and registered is added to and displayed in the sheet list 704.

Next, the process advances to step S604 in which if the CPU 202 detects a press on an OK button 706 on the screen of FIG. 7B, the CPU 202 obtains a sheet type selected on the screen. For example, if the user operates the UI panel 102 to select the "for company A_thick paper 2" 707 and press the OK button 706, the CPU 202 stores the selected "for company A_thick paper 2" in the storage unit 207. Then, the process advances to step S605.

In step S605, the CPU 202 accesses the storage unit 207 and determines whether or not the sheet feed source accepted in step S602 is the sheet feeding apparatus 107. If the sheet feed source is not the sheet feeding apparatus 107 here, the process described in FIGS. 6A and 6B ends. On the other hand, if the CPU 202 determines that the sheet feed source is the sheet feeding apparatus 107, the process advances to step S606 in which the CPU 202 suppresses feeding from the sheet feeding apparatus 107 and advances the process to step S607. In step S607, the CPU 202 accesses the storage unit 207 and determines whether or not contents set via the aforementioned screen of FIG. 5 correspond to a setting in which the image forming apparatus 101 manages the sheet name set in the sheet feeding apparatus 107. If the CPU 202 determines here that the contents do not correspond to the setting in which the image forming apparatus 101 manages the sheet name set in the sheet feeding apparatus 107, the process advances to step S608. In step S608, the CPU 202 displays a screen of FIG. 8A on the UI panel 102.

FIG. 8A depicts a view showing an example of the screen for prompting a sheet setting in the sheet feeding apparatus 107 displayed on the UI panel 102 of the image forming apparatus 101 according to the first embodiment.

This screen is a screen for prompting the user to make the sheet setting on the UI panel 111 (operation unit) of the sheet feeding apparatus 107. Reference numeral 801 denotes a sheet type currently selected in the image forming apparatus 101. The screen further displays recommended values 802 of air-volume parameters when printing on the sheet.

FIG. 8B shows a view illustrating an example of a table that stores the air volume of a sheet absorptive fan decided in accordance with sheet grammage. FIG. 8C shows a view illustrating an example of a table that stores the air volume of a sheet separation fan decided in accordance with the sheet grammage. These tables are stored in the storage unit 207. In step S608, the CPU 202 obtains grammage based on the sheet type accepted in step S604 from the storage unit 207 and accesses the tables in FIGS. 8B and 8C. Then, the CPU 202 displays the air volume of the sheet absorptive fan and the air volume of the sheet separation fan corresponding to the obtained grammage, and displays them in the recommended values 802 of FIG. 8A. The user confirming the screen of FIG. 8A performs a sheet registration operation on the UI panel 111 of the sheet feeding apparatus 107 as a preparation to start printing. Next, the process advances to step S609 in which when the user presses an OK button 803 after the completion of the sheet registration operation in the sheet feeding apparatus 107, the CPU 202 accepts this and advances the process to step S610. In step S610, the CPU 202 cancels suppression of feeding from the sheet feeding apparatus 107, terminating this process. The CPU 202 cancels the suppression of feeding, making it possible to feed a sheet from the sheet feeding apparatus 107 to the image forming apparatus 101. This makes it possible, when the sheet feeding apparatus 107 is selected as the sheet feed source, not to feed the sheet from the sheet feeding apparatus 107 until the user confirms necessity to make a sheet setting in the sheet feeding apparatus 107.

As described above, if the image forming apparatus 101 does not manage the sheet name set in the sheet feeding apparatus 107, the image forming apparatus 101 prompts the user to make the sheet setting in the sheet feeding apparatus 107. Furthermore, the image forming apparatus 101 displays recommended values when a setting for a selected sheet is made on the screen. This makes it possible to prompt the user to do sheet setting work in the sheet feeding apparatus 107 when a sheet setting is made in the UI of the image forming apparatus 101. This allows the user to remember to do the sheet setting work needed for feeding in the sheet feeding apparatus 107.

A case in which the image forming apparatus 101 manages a sheet name set by the user on the UI panel 111 of the sheet feeding apparatus 107 will be described next. That is, an operation by the image forming apparatus 101 in a case in which the sheet name set in the sheet feeding apparatus 107 and a sheet name set in the image forming apparatus 101 are managed in association with each other will be described.

The operation will be described here as a process by the image forming apparatus 101 when a sheet name that has never been set in the sheet feeding apparatus 107 before is set in the sheet feeding apparatus 107. If the image forming apparatus 101 manages the sheet name set by the user in the sheet feeding apparatus 107, the user selects "Yes" and presses the OK button 502 on the screen 501 of FIG. 5. Consequently, the CPU 202 stores the information in the storage unit 207. Consequently, the image forming apparatus 101 manages the sheet name registered in the sheet feeding apparatus 107.

Then, when the user operates the UI panel 102 and gives the instruction to select the sheet feed source, the process shown in the flowcharts of FIGS. 6A and 6B is started. Steps S601 to S607 have already been described, and thus a description thereof will be omitted. In step S607, the CPU 202 determines that the setting in which the image forming apparatus 101 manages the sheet name set in the sheet feeding apparatus 107 is made and advances the process to step S611. In step S611, the CPU 202 accesses a table 901 shown in FIG. 9A.

FIG. 9A depicts a view illustrating an example of the table 901 in which the image forming apparatus 101 manages the sheet name set in the sheet feeding apparatus 107. An example in which the image forming apparatus 101 manages the aforementioned name "a_company_heavy2" input by the sheet feeding apparatus 107 in association with "for company A_thick paper 2" is shown here. In step S611, the CPU 202 determines whether or not the sheet name designated in step S604 is registered in the table 901 from the storage unit 207. If this sheet name is not registered in the table 901, the CPU 202 determines that it is a new name and advances the process to step S612. In step S612, the CPU 202 displays a screen 902 of FIG. 9B on the UI panel 102.

FIG. 9B depicts a view showing an example of the screen for prompting a sheet setting in the sheet feeding apparatus 107 displayed on the UI panel 102 of the image forming apparatus 101 in step S612 according to the first embodiment.

In step S612, the CPU 202 obtains grammage corresponding to the sheet type accepted in step S604 from the storage unit 207, accesses the tables in FIGS. 8B and 8C, and displays recommended values 903 of the air volume of the sheet absorptive fan and the air volume of the sheet separation fan corresponding to the obtained grammage. The user confirms this screen 902 and performs a sheet registration operation via the UI panel 111 of the sheet feeding apparatus 107 as a preparation to start printing. Then, the process advances to step S613 in which the CPU 202 advances the process to step S614 in response to a press on an OK button 904 by the user on the screen 902. In step S614, the CPU 202 displays a screen 905 shown in FIG. 9C on the UI panel 102.

FIG. 9C depicts a view illustrating an example of the screen displayed on the UI panel 102 of the image forming apparatus 101 in step S614 according to the first embodiment. The screen 905 is a screen for accepting an input of the sheet name input by the user in the sheet feeding apparatus 107 for a currently selected sheet.

In step S612, the CPU 202 obtains the sheet name "for company A_thick paper 2" accepted in step S604 from the storage unit 207 and displays it as a sheet name 906. Note that a sheet name input field 907 on this screen 905 is an area for inputting the sheet name input by the sheet feeding apparatus 107. Then, after this screen 905 is displayed, the CPU 202 advances the process to step S615. Here, the user operates the UI panel 102 to display the keyboard, inputs the sheet name input by the sheet feeding apparatus 107 in the input field 907, and presses an OK button 908. Consequently, the CPU 202 registers the sheet name "for company A_thick paper 2" accepted in step S604 in a "sheet name" of the table 901. The CPU 202 further registers the sheet name "a_company_heavy2" input in the input field 907 by the sheet feeding apparatus 107 in a "sheet name on sheet feeding apparatus" of the table 901. Then, the process advances to step S610. Note that the subsequent processes have already been described, and thus a description thereof will be omitted.

A method of managing, by the image forming apparatus 101, a sheet name that has been set by the user on the UI panel 111 of the sheet feeding apparatus 107 will be described next. A process when a sheet that has already been stored in the storage unit 207 of the image forming apparatus 101 in association with the sheet name of the sheet feeding apparatus 107 is set in the image forming apparatus 101 will be described here. Note that a state in which the user selects "Yes" on the screen 501 of FIG. 5 is stored in the storage unit 207 by a user operation in advance. That is, the image forming apparatus 101 is in a state in which the image forming apparatus 101 manages the sheet name registered in the sheet feeding apparatus 107.

The process shown in the flowcharts of FIGS. 6A and 6B is started by causing the user to operate the UI panel 102 and give the instruction to select the sheet feed source. Note that steps S601 to S611 have already been described, and thus a description thereof will be omitted.

In step S611, the CPU 202 accesses the table 901 shown in FIG. 9A, obtains the sheet name designated in step S604 from the storage unit 207, and determines whether or not the obtained sheet name has already been registered in the table 901. When the CPU 202 determines here that the sheet name has already been registered in the table 901, the process advances to step S616. In step S616, the CPU 202 displays a screen 1001 of FIG. 10 on the UI panel 102.

Figure 10:
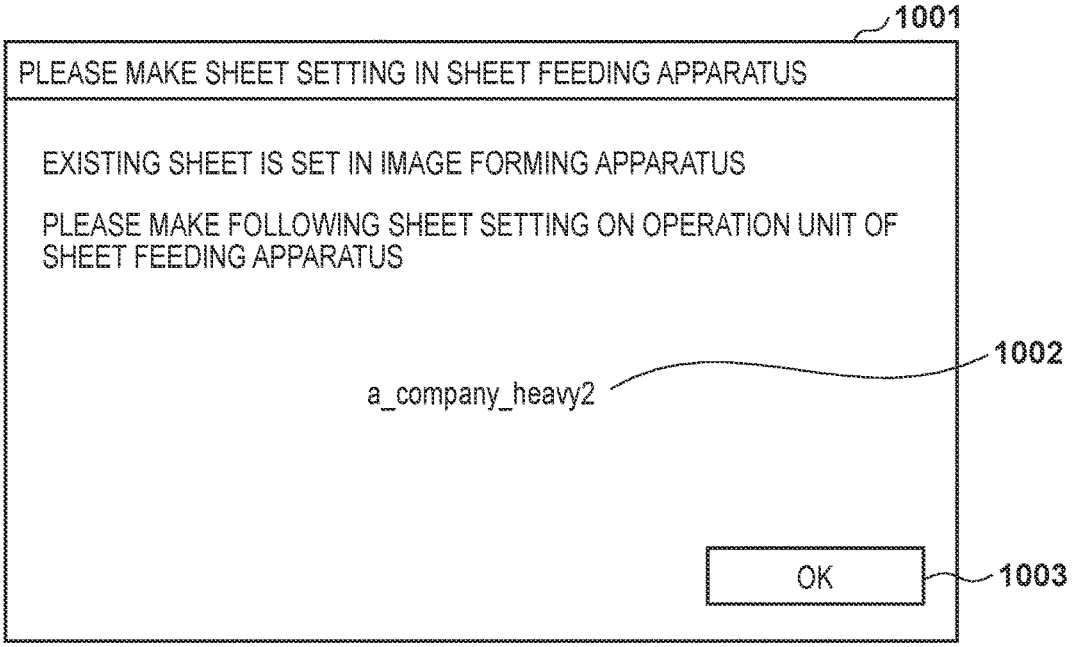
FIG. 10 depicts a view showing an example of a screen for prompting a sheet setting on the UI panel of the sheet feeding apparatus displayed on the UI panel of the image forming apparatus according to the first embodiment.

FIG. 10 depicts a view showing an example of the screen displayed on the UI panel 102 of the image forming apparatus 101 according to the first embodiment. The screen 1001 is a screen for prompting the user to make a sheet setting for a name displayed on the screen 1001 on the UI panel 111 of the sheet feeding apparatus 107.

In step S616, the CPU 202 searches for the sheet name accepted in step S604, for example, "for company A_thick paper 2" from the table 901, obtains a sheet name in the sheet feeding apparatus 107 corresponding to it, and displays the obtained sheet name in an area 1002. Then, the CPU 202 advances the process to step S617. At this time, the user confirms this screen 1001 and performs a sheet registration operation on the UI panel 111 of the sheet feeding apparatus 107 as a preparation to start printing. That is, the user makes a sheet setting for a sheet whose sheet name is "a_company_heavy2" in the sheet feeding apparatus 107. In step S617, when the user presses an OK button 1003 on the screen 1001 after completing a sheet setting operation in the sheet feeding apparatus 107, the CPU 202 advances the process to step S610 in response to the press on this OK button 1003. Then, the subsequent processes have already been described, and thus a description thereof will be omitted.

As described above, according to the first embodiment, it is possible to designate so as to manage the sheet name registered in the sheet feeding apparatus in association with the sheet name registered in the image forming apparatus. This makes it possible to specify a sheet which is selected in the sheet feeding apparatus associated with a sheet selected in the image forming apparatus. Further, if the image forming apparatus does not manage a sheet name registered in the sheet feeding apparatus or if respective set sheet types do not match, it is possible to recommend the sheet type to be set in the sheet feeding apparatus by the image forming apparatus to the user. Furthermore, if a sheet type once registered is used, it is possible to present a UI indicating a specific sheet to be selected in the sheet feeding apparatus to the user.

When the image forming apparatus manages the sheet name registered in the sheet feeding apparatus, if a new sheet type (name) is designated in the image forming apparatus, it is possible to designate a recommended value for an air-volume parameter corresponding to the sheet and prompt a sheet setting in the sheet feeding apparatus. Then, a correspondence between the sheet name set in the sheet feeding apparatus and managed by the sheet feeding apparatus, and the new sheet name managed by the image forming apparatus is stored as a table. If a sheet that has been used before is designated in the image forming apparatus, it is possible to present the name of a sheet which corresponds to the sheet and has been previously set in the sheet feeding apparatus to the user. This allows the user to feed the sheet corresponding to the sheet set in the image forming apparatus by inputting the name of the sheet.

On the other hand, when the image forming apparatus does not manage the sheet name registered in the sheet feeding apparatus, if the type (name) of sheet is designated in the image forming apparatus, a recommended value for an air volume corresponding to the sheet is displayed, allowing the user to select a sheet corresponding to the air volume in the sheet feeding apparatus.

An invoking process for a sheet setting in the sheet feeding apparatus 107 according to the first embodiment will be described next.

Figure 11:
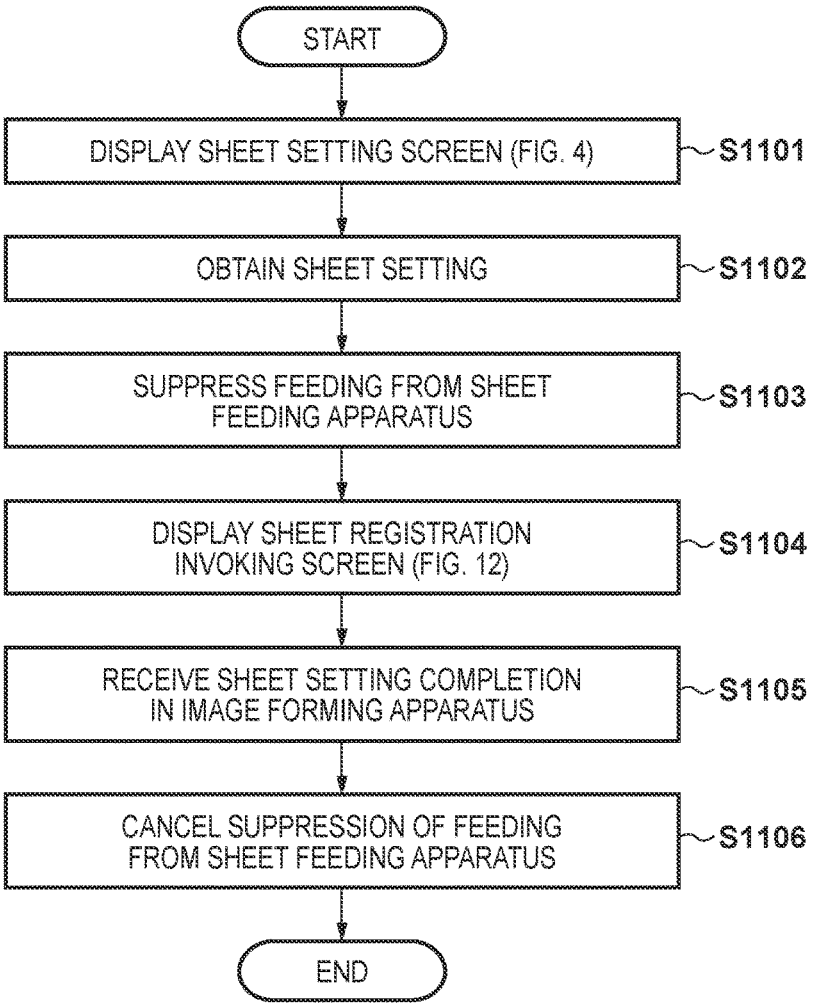
FIG. 11 is a flowchart for describing a process by the sheet feeding apparatus according to the first embodiment.

FIG. 11 is a flowchart for describing a process by the sheet feeding apparatus 107 according to the first embodiment. The process shown in this flowchart is achieved by causing the CPU 212 to deploy programs stored in the storage unit 214 to the RAM 216 and execute them. This process is started by causing the user to operate the UI panel 111 and give an instruction to select a sheet feed source after drawing out the dolly 108 of the sheet feeding apparatus 107 to set a sheet on the sheet base 109 and returning the dolly 108 to the sheet feeding apparatus 107.

First, in step S1101, the CPU 212 displays the screen 401 shown in FIG. 4 on the UI panel 111. Then, the user operates the UI panel 111 to display the keyboard, inputs the parameters for feeding the sheet on the screen 401, and presses the OK button 408. Consequently, the process advances to step S1102 in which the CPU 212 stores the parameters input via the screen 401 in the storage unit 214. Next, the process advances to step S1103 in which the CPU 212 suppresses feeding from the sheet feeding apparatus 107. Next, the process advances to step S1104 in which the CPU 212 displays a screen 1201 of FIG. 12 on the UI panel 111.

Figure 12:
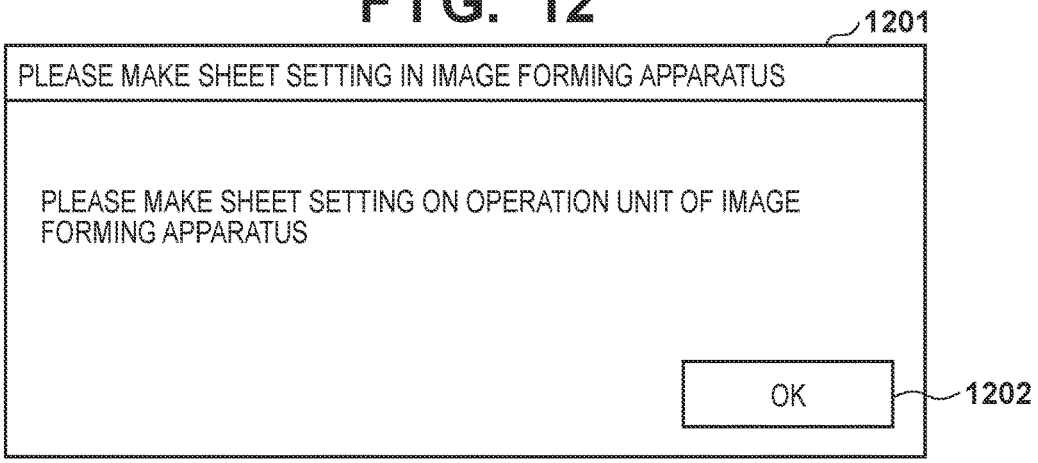
FIG. 12 depicts a view showing an example of a screen for prompting a sheet setting in the image forming apparatus displayed on the UI panel of the sheet feeding apparatus according to the first embodiment.

FIG. 12 depicts a view showing an example of the screen for prompting a sheet setting in the image forming apparatus 101 displayed on the UI panel 111 of the sheet feeding apparatus 107.

Here, the user confirms this screen 1201 and performs a sheet registration operation via the UI panel 102 of the image forming apparatus 101 as a preparation to start printing. Then, when the user presses an OK button 1202 on this screen 1201, the CPU 212 advances the process from step S1105 to step S1106. In step S1106, the CPU 212 cancels suppression of feeding from the sheet feeding apparatus 107 and sets a state capable of feeding from the sheet feeding apparatus 107, terminating this process.

As described above, when sheet registration work is done in the sheet feeding apparatus 107, the user is prompted to register the sheet in the image forming apparatus 101. This makes it possible to prevent the user from forgetting the sheet registration in the image forming apparatus when the sheet registration work is done as a feed preparation in the sheet feeding apparatus.

[Second Embodiment]

In the above first embodiment, the invoking process for the sheet settings in the image forming apparatus and the sheet feeding apparatus has been described. In contrast, in the second embodiment, a process when a print jam occurs during printing in an image forming apparatus 101 will be described. Note that the hardware arrangements and the like of the image forming apparatus 101, a sheet feeding apparatus 107, and the like according to the second embodiment are the same as in the above described first embodiment, and thus a description thereof will be omitted.

Figure 13:
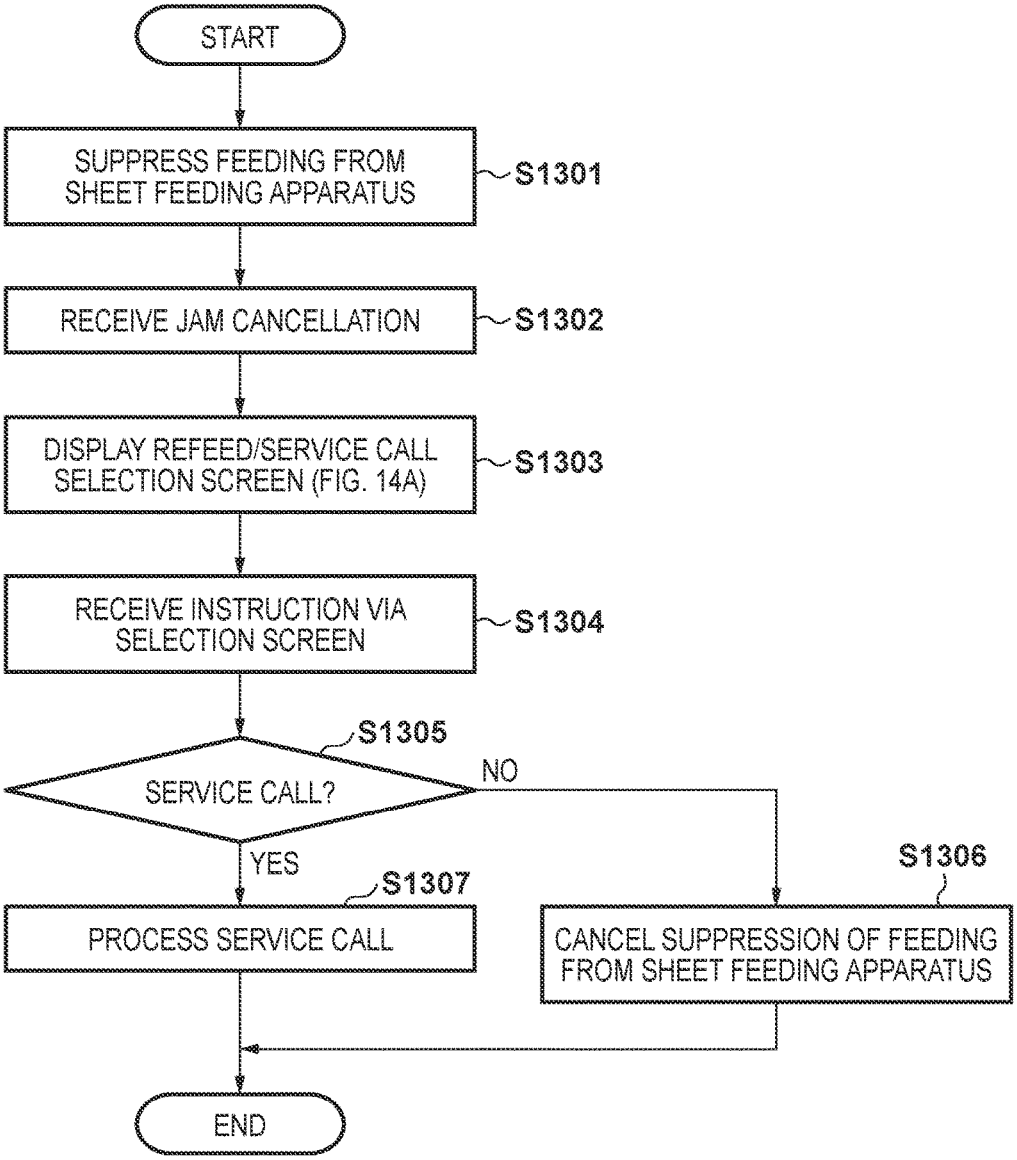
FIG. 13 is a flowchart for describing a process by an image forming apparatus according to the second embodiment.

FIG. 13 is a flowchart for describing a process by the image forming apparatus 101 according to the second embodiment. The process shown in this flowchart is achieved by causing a CPU 202 to deploy programs stored in a storage unit 207 to a RAM 206 and execute them. This process is started by detecting occurrence of the print jam when a sheet is fed from the sheet feeding apparatus 107 to perform printing.

First, in step S1301, the CPU 202 suppresses feeding from the sheet feeding apparatus 107. At this time, when a user removes a sheet that stops on a conveyance path and causes the jam to set a printable state, the CPU 202 accepts that the printable state is set. If the CPU 202 thus detects in step S1302 that the jam is canceled, the process advances to step S1303. In step S1303, the CPU 202 accesses the storage unit 207, extracts information on a screen 1401 of FIG. 14A, and displays it on a UI panel 102.

Figure 14A:
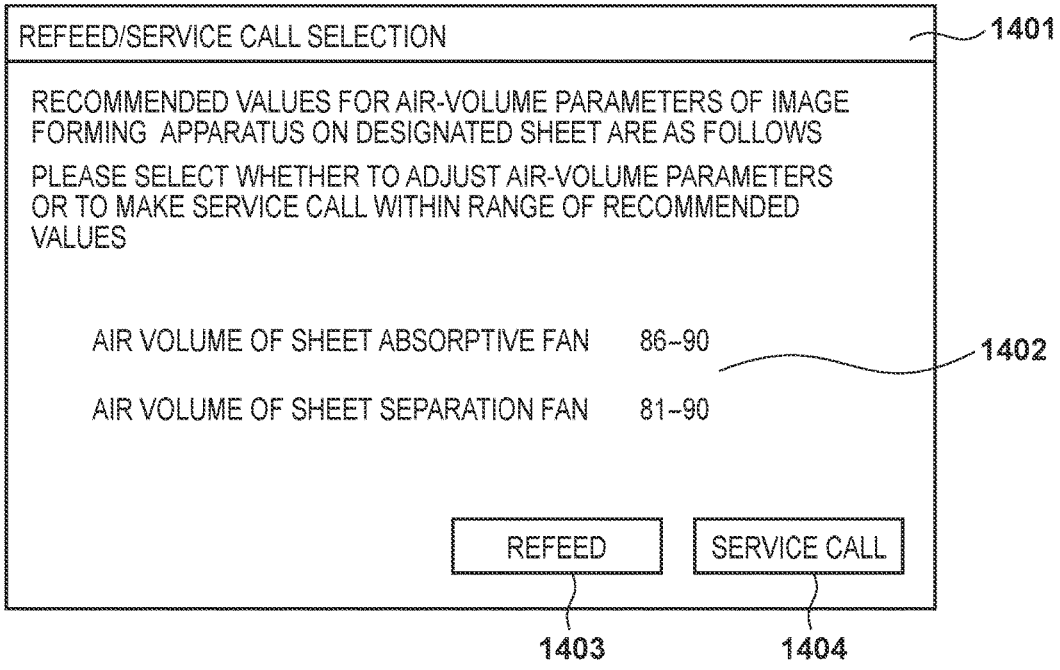
FIG. 14A depicts a view showing an example of a screen for setting whether to change a feeding parameter or whether to make a service call on a UI panel of a sheet feeding apparatus, the screen being displayed on a UI panel of the image forming apparatus according to the second embodiment.

FIG. 14A depicts a view showing an example of the screen for setting whether to change a feeding parameter or whether to make a service call on a UI panel 111 of the sheet feeding apparatus 107 displayed on the UI panel 102 of the image forming apparatus 101.

Here, the CPU 202 obtains, from the storage unit 207, grammage of a sheet being fed, obtains the air volume of a sheet absorptive fan and the air volume of a sheet separation fan corresponding to the obtained grammage from tables of FIGS. 8B and 8C, and displays them in an area 1402. Consequently, the user confirms the screen 1401 and selects whether to change the feeding parameter or whether to make the service call on the UI panel 111 of the sheet feeding apparatus 107. In step S1304, when the user selects a "refeed" button 1403 or a "service call" button 1404, the CPU 202 stores information on the pressed button in the storage unit 207. Next, the process advances to step S1305 in which the CPU 202 accesses the storage unit 207 and confirms contents accepted in step S1304. When the user selects "refeed" here, the process advances to step S1306 in which the CPU 202 cancels suppression of feeding from the sheet feeding apparatus 107, terminating this process.

Figure 14B:
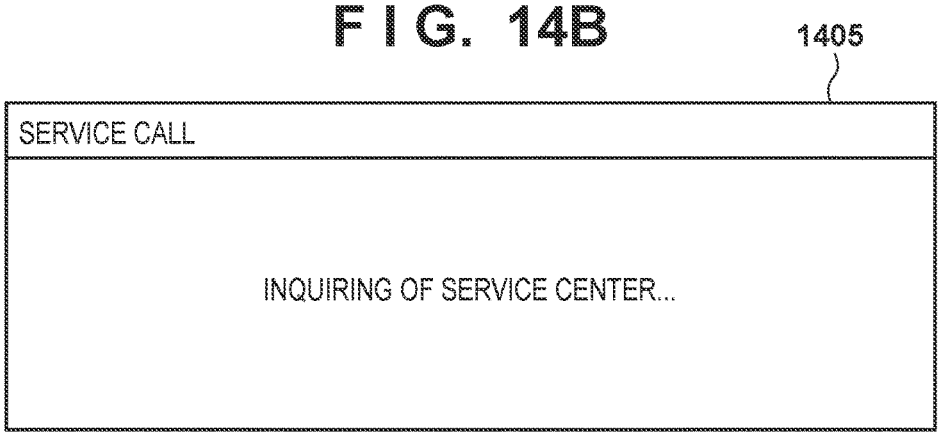
FIG. 14B depicts a view showing an example of a screen at the time of the service call.

On the other hand, if the CPU 202 determines in step S1305 that the user selects "service call", the process advances to step S1307 in which screen information on a screen 1405 of FIG. 14B is obtained and displayed on the UI panel 102. This screen 1405 is a screen indicating that a service regarding the image forming apparatus 101 is being issued. Furthermore, at this time, the CPU 202 makes a notification to a service call center (not shown) via a network. Then, this process ends.

As described above, according to the second embodiment, the user is allowed to select whether to change an air-volume parameter as the feeding parameter of the sheet feeding apparatus to try refeed or whether to contact the service call center upon occurrence of the print jam.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-045254, filed Mar. 9, 2017, which is hereby incorporated by reference herein in its entirety.

What is claimed is:

1. An image forming apparatus having a printer for printing an image on a sheet fed from a sheet feeding apparatus having an operation unit, the image forming apparatus comprising:

a memory device that stores a set of instructions; and at least one print controller that executes the instructions to:

set the sheet feeding apparatus as a sheet feed source of the sheet to be used by the printer for printing;

make a notification to a user to set, via the operation unit, at least one feeding parameter of the sheet feeding apparatus set as the sheet feed source;

cause a user to select a type of sheet fed from the sheet feeding apparatus set as the sheet feed source; and store a sheet type in which sheet information is set in the image forming apparatus and a sheet type in which sheet information is set in the sheet feeding apparatus in association with each other, wherein the notification includes a message indicating that it is necessary to set the feeding parameter of the sheet feeding apparatus set as the sheet feed source and the feeding parameter includes a volume of air blown to a sheet or grammage of the sheet set in the sheet feeding apparatus set as the sheet feed source, wherein in the notification, the at least one print controller makes a notification of the stored sheet type in association with the selected sheet type set in the sheet feeding apparatus, and wherein in a case where the selected sheet type is not stored, the at least one print controller, in the notification, notifies of a feeding parameter selected based on the selected sheet type.

2. The apparatus according to claim 1, wherein the at least one print controller further executes the instructions to:

control not to feed a sheet from the sheet feeding apparatus to the image forming apparatus after setting of the sheet feed source;

receive a user instruction which indicates that the user confirms the notification; and allow the sheet to be fed from the sheet feeding apparatus set as the sheet feed source to the image forming apparatus in accordance with the received user instruction.

3. The apparatus according to claim 1, wherein in the notification, the at least one print controller displays a feeding parameter based on the selected type of sheet.

4. The apparatus according to claim 1, wherein the volume of air is selected based on grammage of the sheet in the notification.

5. An image forming system that includes an image forming apparatus and an external sheet feeding apparatus that is connected to the image forming apparatus and feeds a sheet to the image forming apparatus, the external sheet feeding apparatus having an operation unit, wherein the image forming apparatus comprises:

a first memory device that stores a set of instructions; and at least one print controller that executes the instructions to:

set the sheet feeding apparatus as a sheet feed source of the sheet to be used by the image forming apparatus for printing;

make a notification to a user to set, via the operation unit, at least one feeding parameter of the sheet feeding apparatus set as the sheet feed source;

cause a user to select a type of sheet fed from the sheet feeding apparatus set as the sheet feed source; and store a sheet type in which sheet information is set in the image forming apparatus and a sheet type in which sheet information is set in the sheet feeding apparatus in association with each other, wherein the notification includes a message indicating that it is necessary to set the feeding parameter of the sheet feeding apparatus set as the sheet feed source and the feeding parameter includes a volume of air blown to a sheet or grammage of the sheet set in the sheet feeding apparatus set as the sheet feed source, wherein in the notification, the at least one print controller makes a notification of the stored sheet type in association with the selected sheet type set in the sheet feeding apparatus, and wherein in a case where the selected sheet type is not stored, the at least one print controller, in the notification, notifies of a feeding parameter selected based on the selected sheet type, wherein the sheet feeding apparatus comprises:

a second memory device that stores another set of instructions; and at least one processor that executes the other set of instructions to:

set a feeding parameter of the sheet fed from the sheet feeding apparatus to the image forming apparatus.

6. The system according to claim 5, wherein the at least one print controller further executes the instructions to:

control not to feed a sheet from the sheet feeding apparatus after setting of the sheet feed source;

receive a user instruction which indicates that the user confirms the notification; and allow the sheet to be fed from the sheet feeding apparatus set as the sheet feed source to the image forming apparatus in accordance with the received user instruction.

7. The system according to claim 5, wherein the notification includes a feeding parameter of the sheet fed from the sheet feeding apparatus set as the sheet feed source.

8. The system according to claim 5, wherein the at least one processor further executes the other set of instructions to:

in accordance with a setting for the feeding parameter of the sheet fed to the image forming apparatus, prompt the user to set sheet information of the sheet in the image forming apparatus.

9. The system according to claim 5, wherein the at least one processor further executes the other set of instructions to:

detect a sheet jam with a detection unit;

in accordance with detection of a jam of the sheet fed from the sheet feeding apparatus, make a notification of a feeding parameter corresponding to the selected type of sheet; and accept, from the user, selection of whether to change the feeding parameter to refeed in the sheet feeding apparatus in response to the notification of the feeding parameter.

10. A method of controlling an image forming apparatus capable of printing an image on a sheet fed from an external sheet feeding apparatus, the method comprising:

setting the sheet feeding apparatus as a sheet feed source of the sheet to be used for printing an image;

making a notification to a user to set at least one feeding parameter of the sheet feeding apparatus set as the sheet feed source of the sheet in the setting;

causing a user to select a type of sheet fed from the sheet feeding apparatus set as the sheet feed source; and storing a sheet type in which sheet information is set in the image forming apparatus and a sheet type in which sheet information is set in the sheet feeding apparatus in association with each other, wherein the notification includes a message indicating that it is necessary to set the feeding parameter of the sheet feeding apparatus set as the sheet feed source and the feeding parameter includes a volume of air blown to a sheet or grammage of the sheet set in the sheet feeding apparatus set as the sheet feed source wherein making the notification includes making a notification of the stored sheet type in association with the selected sheet type set in the sheet feeding apparatus, and wherein if the selected sheet type is not stored, the notification includes a feeding parameter selected based on the selected sheet type.

* * * * *